US008966725B2

(12) United States Patent
Langelier

(10) Patent No.: US 8,966,725 B2
(45) Date of Patent: Mar. 3, 2015

(54) FUNERAL URN SYSTEM AND METHOD OF USING SAME

(71) Applicant: Marc Langelier, Durham Sud (CA)

(72) Inventor: Marc Langelier, Durham Sud (CA)

( * ) Notice: Subject to any disclaimer, the term of this patent is extended or adjusted under 35 U.S.C. 154(b) by 49 days.

(21) Appl. No.: 13/738,131

(22) Filed: Jan. 10, 2013

(65) Prior Publication Data

US 2013/0185907 A1 Jul. 25, 2013

(30) Foreign Application Priority Data

Jan. 19, 2012 (GB) ..... 1200948.6

(51) Int. Cl.

| | |
|---|---|
| ***A61G 17/00*** | (2006.01) |
| ***E04H 13/00*** | (2006.01) |
| ***A61G 17/08*** | (2006.01) |
| ***A61G 99/00*** | (2006.01) |

(52) U.S. Cl.

CPC ..... *E04H 13/008* (2013.01); *A61G 17/08* (2013.01); *A61G 99/00* (2013.01)

USPC ..... 27/1; 27/35; 52/128

(58) Field of Classification Search

USPC ..... 27/1, 35; 52/128, 133, 134, 136, 103, 52/104; 220/23.88; 37/300; 405/129.55

See application file for complete search history.

(56) References Cited

U.S. PATENT DOCUMENTS

| | | | | |
|---|---|---|---|---|
| 3,188,712 | A * | 6/1965 | Bauermeister | 27/6 |
| 3,581,452 | A * | 6/1971 | Jalbert | 52/133 |
| 3,681,820 | A * | 8/1972 | Jalbert | 27/7 |
| 3,898,718 | A * | 8/1975 | Eubank | 27/35 |
| 3,940,894 | A * | 3/1976 | Nunes | 52/129 |
| 4,328,606 | A * | 5/1982 | Nunes | 27/35 |
| 4,893,385 | A * | 1/1990 | Schrag | 27/35 |
| 4,977,652 | A * | 12/1990 | Graham | 27/1 |
| 6,052,954 | A * | 4/2000 | Dudek et al. | 52/128 |
| 6,055,793 | A * | 5/2000 | Irwin et al. | 53/436 |
| 6,295,705 | B1 * | 10/2001 | Gersten | 27/1 |
| 6,421,890 | B1 * | 7/2002 | Biggar | 27/1 |
| 6,484,457 | B1 * | 11/2002 | Dudek et al. | 52/128 |
| 6,493,911 | B1 * | 12/2002 | Troin et al. | 27/1 |
| 6,520,606 | B1 * | 2/2003 | Robinson | 312/111 |
| 7,036,195 | B2 * | 5/2006 | Glass | 27/1 |
| 7,127,783 | B1 * | 10/2006 | Poole et al. | 27/1 |
| 7,478,461 | B2 * | 1/2009 | Glass | 27/1 |
| 7,631,404 | B2 * | 12/2009 | Scruggs | 27/35 |
| 7,937,814 | B2 * | 5/2011 | Voit | 27/1 |
| 7,987,564 | B2 * | 8/2011 | Leeder | 27/1 |
| 8,046,883 | B2 * | 11/2011 | Scruggs | 27/35 |
| 8,214,979 | B2 * | 7/2012 | Scruggs | 27/35 |
| 8,479,362 | B2 * | 7/2013 | Scruggs | 27/21.1 |
| 2002/0144383 | A1 * | 10/2002 | Spence | 27/35 |
| 2003/0221300 | A1 * | 12/2003 | Caven | 27/1 |

* cited by examiner

*Primary Examiner* — William Miller

(57) ABSTRACT

A funeral urn system comprising: a funeral urn defining an urn proximal attachment and a substantially opposed urn distal attachment, the funeral urn including an urn body defining an ashes receiving cavity and an urn aperture leading into the ashes receiving cavity, the funeral urn also including an urn cap selectively securable to the urn body in register with the urn aperture to seal the ashes receiving cavity; and a spear head cap, the spear head cap defining a cap proximal attachment and a substantially opposed cap distal end section tapering in a direction leading away from the cap proximal attachment. The urn proximal and distal attachments are configured and sized to be selectively attachable respectively to the urn distal and proximal attachments of another urn similar to the funeral urn. The urn distal attachment is configured and sized to be selectively attachable to the cap proximal attachment.

19 Claims, 4 Drawing Sheets

FUNERAL URN SYSTEM AND METHOD OF USING SAME

FIELD OF THE INVENTION

The present invention relates generally to the field of cremation, and, more particularly, to a funeral urn system and a method of using same.

BACKGROUND

The prior art proposes numerous funeral urn systems usable for burying a plurality of funeral urns in the ground. The funeral urn systems of the prior art generally comprise one or more closable tubular elements buried or otherwise formed in the ground of a burial site, and in which are inserted one or more funeral urns.

While these prior art devices can generally fulfill the main objective of allowing the burial of one or more funeral urns in the grounds, they also entail one or more of the following disadvantages.

The funeral urn systems of the prior art generally require the digging of a bore or multiple bores in the ground, which inevitably involves additional costs related to managing the thus excavated earth and sometimes providing post-earthworks and land terracing. In the case of recycled burial sites, additional costs may be related to managing bone pieces and coffin material excavated therefrom.

The maximum number of funeral urns that can be buried in a single bore provided in the ground is generally limited to depth of the latter.

The funeral urn systems of the prior art generally do not provide a relatively simple means of retrieving the urns from the burial site once they have been inserted are buried therein.

Some funeral urn systems of the prior art further require expensive drilling equipment and additional headstone elements for providing a burial site ready to receive funeral urns.

Against this background, there exists a need for an improved funeral urn system. An object of the present invention is to provide such an improved funeral urn system.

SUMMARY OF THE INVENTION

In a broad aspect, the invention provides a funeral urn system, the funeral urn system comprising: a funeral urn defining an urn proximal attachment and a substantially opposed urn distal attachment, the funeral urn including an urn body defining an ashes receiving cavity and an urn aperture leading into the ashes receiving cavity, the funeral urn also including an urn cap selectively securable to the urn body in register with the urn aperture to seal the ashes receiving cavity; and a spear head cap, the spear head cap defining a cap proximal attachment and a substantially opposed cap distal end section tapering in a direction leading away from the cap proximal attachment. The urn proximal and distal attachments are configured and sized to be selectively attachable respectively to the urn distal and proximal attachments of an other urn similar to the funeral urn; and the urn distal and cap proximal attachments are configured and sized to be selectively attachable to each other.

In a variant, the funeral urn system further comprises a burial sleeve having a substantially elongated tubular configuration, the burial sleeve being configured and sized for slidably receiving thereinto, for example substantially freely slidably, the funeral urn with the spear head cap attached to the urn distal attachment.

In some embodiments of the invention, the burial sleeve defines substantially longitudinally opposed sleeve proximal and distal apertures and a sleeve passageway extending therebetween, the sleeve proximal and distal apertures being configured and sized to allow movement of the funeral urn therethrough with the spear head cap attached to the urn distal attachment.

In some embodiments of the invention, a burial marker cap is positionable across the sleeve proximal aperture and attachable to the burial sleeve.

In some embodiments of the invention, the burial sleeve is configured and sized for receiving a stack of urns including a plurality of the funeral urn attached to each other through the urn proximal and distal attachments.

In some embodiments of the invention, one of the urn proximal and distal attachments includes an attachment protrusion extending substantially longitudinally away from the remainder of the funeral urn and a locking prong extending substantially laterally away from the attachment protrusion spaced apart from the remainder of the funeral urn so as to define an attachment gap between the remainder of the funeral urn and the locking prong; and an other one of the urn proximal and distal attachments includes an attachment recess extending substantially longitudinally into the urn body from an attachment recess outer end to a substantially longitudinally opposed attachment recess inner end, the other one of the urn proximal and distal attachments also defining a locking channel extending substantially laterally from the attachment recess and a locking groove extending substantially circumferentially from the locking channel peripherally relative to the attachment recess and spaced apart from the attachment recess outer end, the attachment recess and the locking channel being respectively configured and sized for longitudinally receiving the attachment protrusion and the locking prong thereinto, the locking groove being also configured and sized for receiving the locking prong thereinto when said attachment protrusion is in said attachment recess.

For example, the attachment protrusion and the attachment recess each have a substantially cylindrical configuration.

In a specific embodiment of the invention, the locking channel extends over an arc segment that is between about 45 degrees and about 270 degrees in angular extent.

In some embodiments of the invention, the one of the urn proximal and distal attachments is the urn proximal attachment and the other one of the urn proximal and distal attachments is the urn distal attachment.

In some embodiments of the invention, the cap proximal attachment is similar to the urn proximal attachment.

In some embodiments of the invention, the urn body defines an urn body proximal surface adjacent the urn proximal attachment, the urn aperture extending through the urn body proximal surface, the urn proximal attachment being defined by the urn cap.

In some embodiments of the invention, the cap distal end section defines a point opposed to the cap proximal attachment. For example, the cap distal end section is substantially conical.

In a variant, the funeral urn system further comprises a burial marker cap, the burial marker cap including a marker distal attachment selectively attachable to the urn proximal attachment.

In a variant, the funeral urn system further comprises a burial sleeve having a substantially elongated tubular configuration, the burial sleeve being configured and sized for substantially freely slidably receiving thereinto the funeral urn with the spear head cap attached to the urn distal attachment, the burial sleeve defining substantially longitudinally opposed sleeve proximal and distal apertures and a sleeve passageway extending therebetween, the sleeve proximal and distal apertures being configured and sized to allow the funeral urn to go therethrough with the spear head cap attached to the urn distal attachment; and a burial tool for inserting the burial sleeve into a ground, the burial tool including a driving stake, the driving stake including a driving element defining a driving element point and configured and sized so as to be substantially fittingly received in the burial sleeve, the driving stake also including a spacing member extending from the driving element substantially away from the driving element point, the spacing member being configured and sized so as to extend along about the whole length of the burial sleeve and protrude proximally therefrom when the driving element is positioned in the burial sleeve with the driving element point protruding from the sleeve distal aperture.

In some embodiments of the invention, the burial tool further includes an impact anvil of a larger diameter than the burial sleeve and positionable across the burial sleeve opposed to the driving element, the impact anvil defining a spacing member receiving portion for receiving part of the spacing member thereinto.

In a variant, the impact anvil defines an anvil recess for receiving the urn cap and an anvil shoulder extending peripherally relative to the anvil recess for abutting against the urn body with the urn cap is received in the anvil recess.

In a variant, the urn proximal and distal attachments are configured and sized to be selectively reversibly attachable respectively to the urn distal and proximal attachments of the other urn.

In another broad aspect, the invention provides a method of burying a funeral urn, the method comprising: burying in the ground part of a substantially tubular burial sleeve, the burial sleeve defining a sleeve proximal aperture, a substantially longitudinally opposed sleeve distal aperture and a sleeve passageway extending therebetween, the sleeve passageway being substantially empty after the burial sleeve has been buried into the ground; and inserting the funeral urn in the burial sleeve.

In a variant, the method further comprises closing the sleeve proximal aperture using a burial marker cap.

In a variant, the funeral urn is part of an urn stack including a plurality of the funeral urn attached to each other, the urn stack terminating in a point, inserting the funeral urn in the burial sleeve including inserting the urn stack in the burial sleeve.

In a variant, the urn stack is longer than the burial sleeve, the method further comprising pushing the urn stack into the ground such that the urn stack protrudes from the sleeve distal aperture.

Some advantages of the funeral urn system and method of the present invention are as follows.

In typical use, the funeral urn system does not require any digging at all since a bore in the ground for the funeral urns is formed through the use of the burial tool. Thus, the use of the funeral urn system described above avoids costly operations deriving from digging burial graves, post-burial earthworks and land terracing, as well as costs related to the management of bone pieces and coffin material excavated from recycled burial sites.

The number of funeral urns that can be serially buried in the ground at a single location is relatively larger than for other funeral urn systems of the prior art since additional funeral urns may be serially buried in an already filled up burial bore provided in the ground, by using the burial tool.

The funeral urn system may be advantageously used to recycle disused burial sites since the impact resistant and spear-shaped head cap positioned at a distal end of the burial tool and at the distal end of serially engaged funeral urns, can relatively easily drive its way through earth, gravel, multiple buried coffins and loose rocks.

Serially buried funeral urns at a single location may be relatively easily retrieved from a burial site, for examples, when a forensic examination and analysis on a particular funeral urn is required, or a particular funeral urn needs to be relocated at another site.

Prior to, or alternatively to, the burial operation, the funeral urns may as well be individually used for conventional display on a horizontal surface at home or at a mausoleum.

The components of the funeral urn system of the present invention are typically relatively simple and economical to manufacture.

Other objects, advantages and features of the present invention will become more apparent upon reading of the following non-restrictive description of some embodiments thereof, given by way of example only with reference to the accompanying drawings.

DETAILED DESCRIPTION

Figure 16:
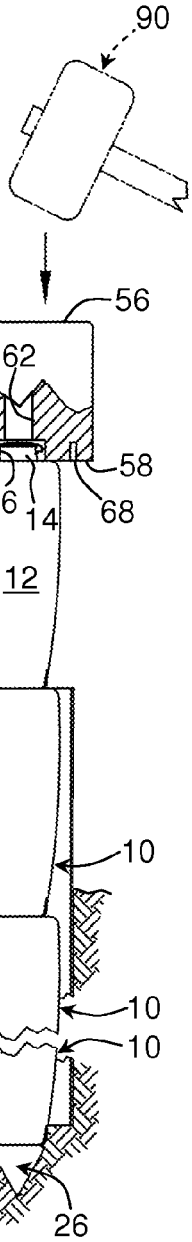
FIG. 16, in a partial side elevational, cross-sectional view, illustrates the use of an impact anvil and a sledge hammer for burying deeper in the ground a series of mutually engaged stacked sealed funeral urns and spear head cap, all slidably engaged in a burial sleeve, itself partially buried in the ground.

FIGS. 1 to 16 show various aspects of a funeral urn system 11 usable for the burial of one or more funeral urns 10 in a stackable manner at a single vertical location in the ground 13, as seen for example in FIG. 16.

Figure 15:
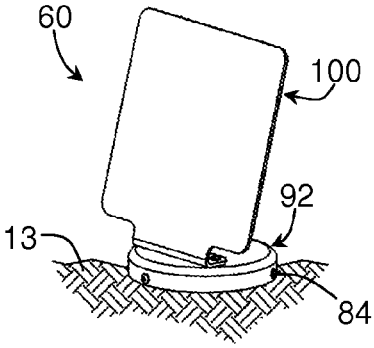
FIG. 15, in a top perspective view, illustrate the elements shown in FIG. 14 in an assembled state.

The funeral urn system 11 generally includes a burial sleeve 40 having a substantially elongated tubular configuration that can be partially buried in the ground 13 and closable with a burial marker cap 60 (seen in FIG. 15). The funeral urn system 11 further comprises at least one funeral urn 10 and a spear head cap 26. Typically, the funeral urn system 11 is used by assembling one or a series of more than one serially engaged funeral urns 10 that are in turn serially engaged between the burial marker cap 60 and the spear head cap 26. The burial sleeve 40 is configured and sized for substantially freely slidably receiving thereinto the funeral urn 10, or the series of funeral urns 10, with the spear head cap 26 attached to the distalmost funeral urn 10. In some embodiments of the invention, the funeral urn system 11 further comprises a burial tool 50, seen for example in FIG. 1, usable for burying in the ground 13 the burial sleeve 40 as well as burying deeper in the ground 13 a series of mutually engaged funeral urns 10 assembled with a spear head cap 26 that are slidably engaged in the burial sleeve 40 buried in the ground 13.

Figure 3:
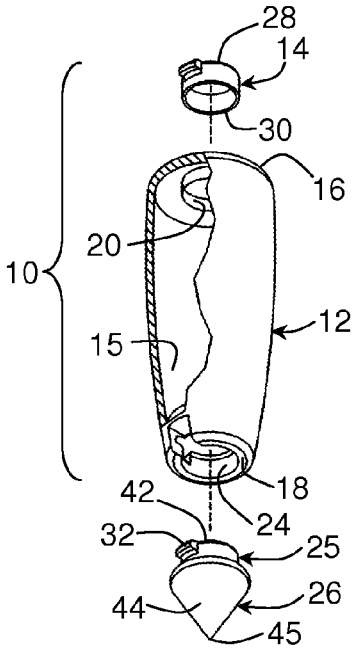
FIG. 3, in a partial, bottom perspective exploded view, illustrates a funeral urn part of the funeral urn system, the funeral urn including an urn body, an urn cap and a spear head cap.

FIGS. 3 to 10 show more particularly various aspects of an embodiment of a funeral urn 10 part of the funeral urn system 11, according to the present invention. As best illustrated in FIG. 3, the funeral urn 10 generally includes an urn body 12 for containing the funeral ashes of a deceased individual (not shown in the drawings), and an urn cap 14 for sealing the funeral urn 10.

The urn body 12 and urn cap 14 are typically made of a substantially impact resistant and rust proof material, or combination of materials, such as, for example, stainless steel, a rust-proof iron, wood, a polymeric material, a bio-degradable material, and the likes. In a specific embodiment of the invention, the urn body 12 and urn cap 14 are made of stainless steel for extended durability once the funeral urn 10 is buried, for example, in the ground 13 or in a sea bottom, or simply dropped in the sea.

Typically, the urn body 12 has a generally cylindrical and hollow configuration defining an ashes receiving cavity 15. The urn body 12 also defines an urn proximal end 16 and an urn distal end 18. The urn body 12 defines an urn aperture 20 leading to the ashes receiving cavity 15 through which the ashes may be poured in. The urn aperture 20 is shaped and sized for receiving and selectively sealingly securing thereto the urn cap 14 in register therewith. Typically, the urn aperture 20 is provided at the urn proximal end 16 and has a relatively smaller diameter with respect to the diameter of the urn body 12, thus defining an urn proximal surface 22 (seen for example in FIG. 4) therearound.

The terminology distal and proximal refers to the distance from an intended user of the funeral urn system 11 in a typical use in which the funeral urns 10 are inserted vertically in the ground 13. Therefore, distal elements are buried deeper in the ground 13 than distal elements. This terminology is used to facilitate the description of the funeral urn system 11 and should not be used to restrict the scope of the present invention. Also, the terminology "substantially" is used to denote variations in the thus qualified terms that have no significant effect on the principle of operation of the funeral urn system 11. These variations may be minor variations in design or variations due to mechanical tolerances in manufacturing and use of the funeral urn system 11. These variations are to be seen with the eye of the reader skilled in the art.

Figure 5:
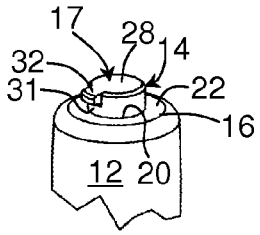
FIG. 5, in a partial, top perspective view, illustrates an urn cap attached to, and sealably closing, an urn aperture of the urn body.
Figure 6:
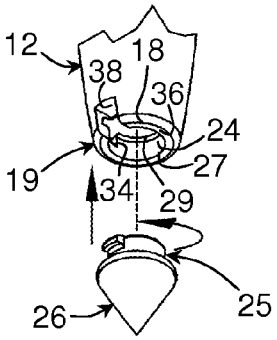
FIG. 6, in a partial, bottom perspective exploded view, illustrates the spear head cap in position for twist and lock engagement with a attachment recess of the funeral urn.

The funeral urn 10 defines an urn proximal attachment 17, better seen for example in FIG. 5, and a substantially opposed urn distal attachment 19 (seen in FIG. 6). The urn proximal and distal attachments 17 and 19 are configured and sized to be selectively attachable, typically reversibly, respectively to the urn distal and proximal attachments 19 and 17 of another urn 10 similar to the funeral urn 10.

Also, as seen for example in FIG. 3, the spear head cap 26 defines a cap proximal attachment 25 and a substantially opposed cap distal end section 44 tapering in a direction leading away from the cap proximal attachment 25. The urn distal attachment 19 is configured and sized to be selectively attachable to the cap proximal attachment 25.

A specific embodiment of the urn proximal and distal attachments 17 and 19 is described hereinbelow. In this embodiment, the urn proximal attachment 17 is a "male" attachment defining a protrusion and the urn distal attachment 19 is a "female" attachment defining a recess for receiving the protrusion. However, it is within the scope of the present invention to reverse the locations of the male and female attachments. Also, other types of attachments can be used without departing from the scope of the invention.

Figure 8:
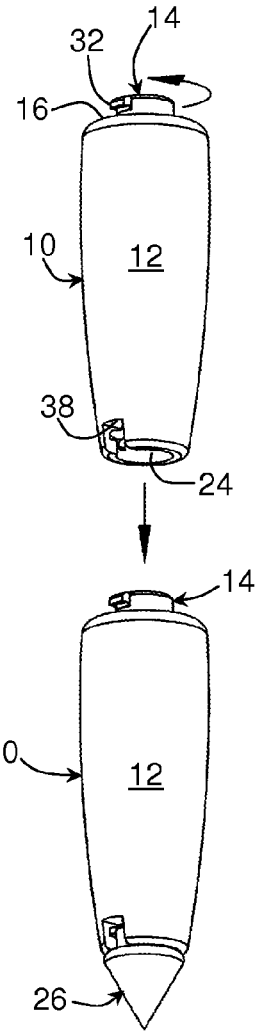
FIG. 8, in a bottom perspective view, illustrates a first sealed funeral urn in position for twist and lock engagement above a second sealed funeral urn, which in turn is lockingly engaged with the spear head cap.
Figure 4:
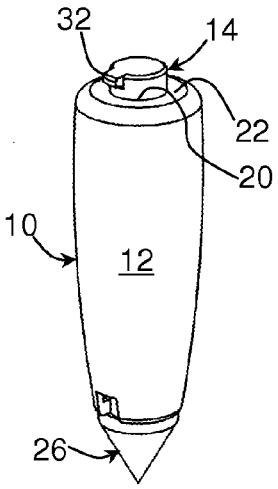
FIG. 4, in a top perspective view, illustrates the funeral urn of FIG. 3 with the funeral urn sealed by the urn cap and attached to the spear head cap.
Figure 7:
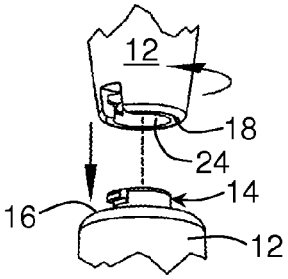
FIG. 7, in a partial, bottom perspective exploded view, illustrates the urn distal end section of the funeral urn in position for lockable engagement with the urn cap of another sealed funeral urn.
Figure 9:
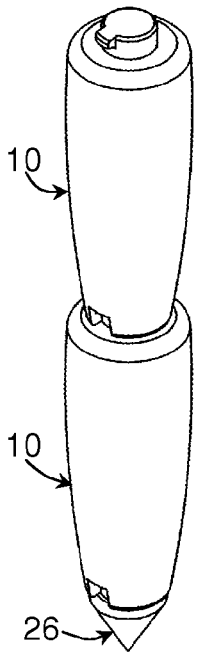
FIG. 9, in a top perspective view, illustrates the sealed funeral urns of FIG. 8 in an assembled state.
Figure 10:
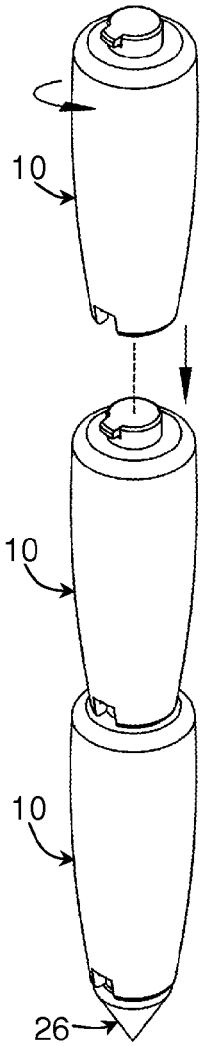
FIG. 10, in a top perspective view, illustrates an additional sealed funeral urn in position for twist and lock engagement with the proximal end of the pair of assembled funeral urns illustrated in FIG. 9.

More specifically, referring to FIG. 6 for example, the urn distal attachment 19 includes an attachment recess 24 extending substantially longitudinally into the urn body 12 from an attachment recess outer end 27 to a substantially longitudinally opposed attachment recess inner end 29. In other words, the attachment recess 24 extends in a proximal direction. The attachment recess 24 is shaped and sized for selectively engaging, in a twist and lock relation, either an urn cap 14 that is typically sealingly attached to another funeral urn 10, as best illustrated in FIGS. 7 and 8, or the cap proximal attachment 25 of a spear head cap 26, as illustrated in FIGS. 3, 4 and 6. Typically, the attachment recess 24 has a cylindrical configuration.

The urn proximal attachment 17 is defined by the urn cap 14. To that effect, as seen for example in FIG. 3, the urn cap 14 is typically generally cylindrical and defines an urn cap proximal end 28 and an urn cap distal end 30. The urn cap distal end 30 is configured and size for abutting against and sealingly closing the urn aperture 20 of the urn body 12 using any conventional means such as a soldering process, a thermal bonding process, glue, or the likes. The attachment recess 24 is configured and sized for longitudinally receiving the urn cap 14 thereinto.

The urn cap 14 therefore forms an attachment protrusion extending substantially longitudinally away from the remainder of the funeral urn 10. The urn cap proximal end 28 is closed with a circular proximal wall member and provided with a locking prong 32 extending laterally away from a circumferential portion thereof, or in other words from the attachment protrusion. The locking prong 32 is spaced apart from the remainder of the funeral urn 10 so as to define an attachment gap 31 (seen for example in FIG. 5) between the remainder of the funeral urn 10 and the locking prong 32. The locking prong 32 is shaped and sized for slidably engaging in a compatibly shaped and sized locking channel 38 (seen for example in FIG. 6) extending substantially laterally from the attachment recess 24. The locking channel 38 is configured and sized for longitudinally receiving the locking prong 32 thereinto.

The attachment recess 24 has a substantially cylindrical configuration extending inwardly in a proximal direction relative to the urn distal end 18, thus defining a distal circumferential edge 36. The attachment recess 24 has a diameter that is suitably sized for substantially freely slidably receiving therein the urn cap 14.

A locking groove 34 extends substantially circumferentially from the locking channel 38 peripherally relative to the attachment recess 24 and spaced apart from the attachment recess outer end 29. The locking groove 34 is therefore a partially-circular groove extending along an proximal inner cylindrical surface portion of the attachment recess 24, with one end originating at the locking channel 38. The locking groove 34 may extend around the inner cylindrical surface of the attachment recess 24, for example, between one eighth (⅛) and three-quarter (¾) of a circle. This corresponds to the locking groove 34 extending over an arc segment that is between about 45 degrees and about 270 degrees in angular extent. For example, the locking groove 34 extends one-quarter (¼) of a circle. The locking groove 34 is configured and sized for receiving the locking prong 32 thereinto.

Furthermore, and for esthetic reasons, when the urn cap 14 is sealingly attached to the urn aperture 20, the locking prong 32 is typically longitudinally aligned with the locking channel 38. Thus, the funeral urn 10 may be conveniently positioned and radially oriented for display, for example, on a shelf, such that both the locking prong 32 of the urn cap 14 and the locking channel 38 of the urn body 12 are substantially hidden behind the funeral urn 10.

Figure 1:
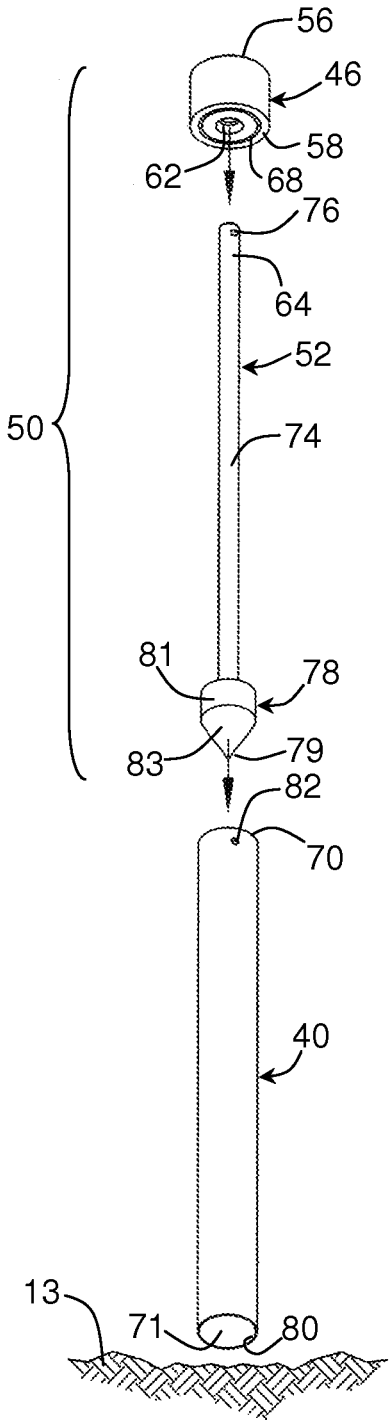
FIG. 1, in a bottom perspective, exploded view, illustrates an impact anvil, a driving stake, and a burial sleeve part of a funeral urn system.
Figure 11:
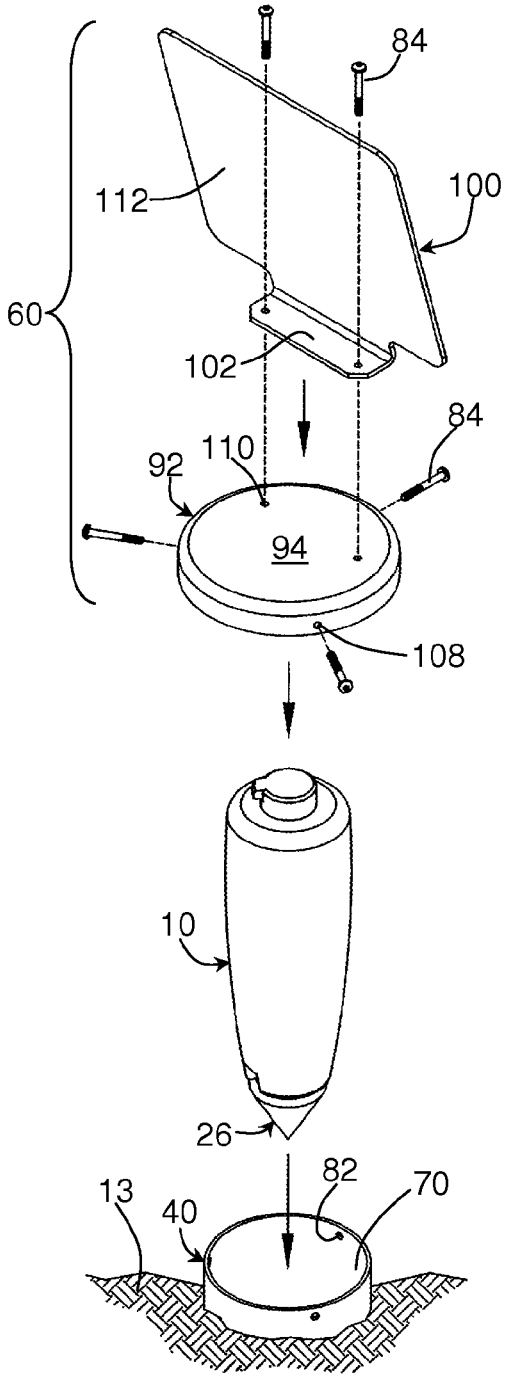
FIG. 11, in a top perspective, exploded view, illustrates a burial marker cap and a sealed funeral urn equipped with a spear head cap, in position above a burial sleeve partially buried in the ground.

The funeral urn 10 typically has a diameter that is relatively slightly smaller than the inner diameter of the burial sleeve 40 selectively used for the burial of one or more funeral urns 10 in a longitudinal serial fashion into the ground 13. Referring to FIG. 1, the burial sleeve 40 defines substantially longitudinally opposed sleeve proximal and distal apertures 70 and 80 and a sleeve passageway 71, better seen in FIG. 2, extending therebetween. The sleeve proximal and distal apertures 70 and 80 are configured and sized to allow movement of the funeral urn 10 therethrough with the spear head cap 26 attached to the urn distal attachment 19. Typically, the burial sleeve 40 is configured and sized for receiving a stack of urns including a plurality of the funeral urn 10 attached to each other through the urn proximal and distal attachments 17 and 19, as seen in FIG. 11.

Furthermore, in some embodiments of the invention, the funeral urn 10 may have an overall longitudinal length, which includes the urn body 12 and the urn cap 14, that is roughly between 6 inches and 2 feet (roughly between 15.2 cm and 60.9 cm). For example, the funeral urn 10 has an overall longitudinal length of roughly one foot (30.5 cm).

In an alternative embodiment of a funeral urn system 11 (not shown), according to the present invention, the funeral urn 10 has the locking channel 38 replaced with a channel extending vertically along an inner circumferential portion of the attachment recess 24, and which is having sufficient dimension for allowing the locking prong 32 of an urn cap 14 to be substantially freely slidably inserted vertically therealong in order to reach one end of the horizontally extending locking channel 38. Thus, there is no notch that is visibly apparent along the outer circumferential surface of the urn body 12.

Referring to FIG. 3, the spear head cap 26 defines a cap proximal end 42 and a cap distal end section 44 opposed thereto. The spear head cap 26 is substantially identically shaped and sized as the urn cap 14 adjacent the cap proximal end 42, including a spear head cap locking prong 32. The cap proximal attachment 25 is for lockingly engaging into the attachment recess 24 of a funeral urn 10. Therefore, the cap proximal attachment 25 is similar to the urn proximal attachment 17.

The cap distal end section 44 defines a point 45 opposed to the cap proximal attachment 25. For example, the cap distal end section 44 is substantially conical and usable as an impact boring head in cooperative relation with an impact anvil 46, which will be described further below.

The spear head cap 26 is made of a substantially impact-proof and rust proof material. Typically, the spear head cap 26 may be made of the same material as the funeral urn 10.

In an alternative embodiment of a funeral urn system 11, according to the present invention, the attachment recess 24 and spear head cap 26 may both be provided with more than one locking prong 32 with corresponding locking channel 38 and locking groove 34 combinations. For example, in alternate embodiments, the attachment recess 24 and spear head cap 26 may be provided with either two or three locking prongs 32, locking channel 38 and locking groove 34 combinations.

Figure 2:
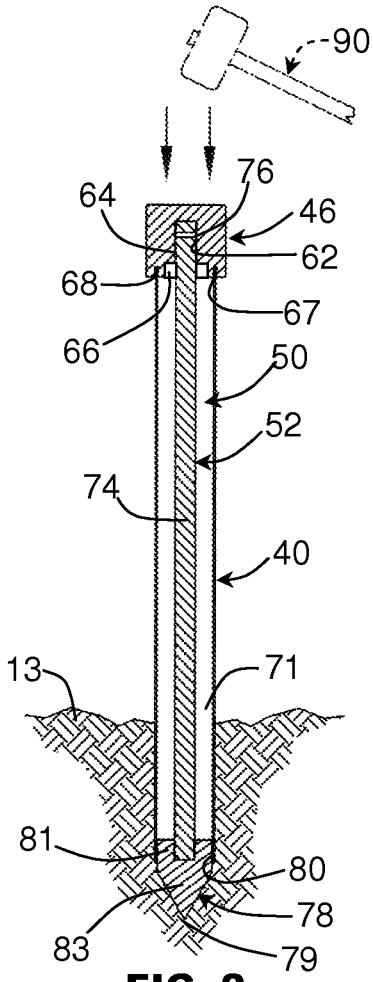
FIG. 2, in a side cross-sectional view, illustrates the impact anvil, driving stake and burial sleeve of FIG. 1 in an assembled state.

Various aspects of a burial tool 50 for inserting the burial sleeve 40 into a ground 13 are illustrated in FIGS. 1 and 2. The burial tool 50 is usable, in cooperative relation with the substantially elongated and tubular burial sleeve 40 and a burial marker cap 60, for the burial in the ground 13 of one or more funeral urn 10, as illustrated in FIGS. 11 to 16 inclusively, as described hereinbelow.

The burial tool 50 generally includes an impact anvil 46 and a driving stake 52. The driving stake 52 includes a driving element 78 defining a driving element point 79 and configured and sized so as to be substantially fittingly received in the burial sleeve 40. The driving stake 52 also includes a spacing member 74 extending from the driving element 78 substantially away from the driving element point 79. The spacing member 74 is configured and sized so as to extend along about the whole length of the burial sleeve 40 and protrude proximally therefrom when the driving element 78 is positioned in the burial sleeve 40 with the driving element point 79 protruding from the sleeve distal aperture 80.

The impact anvil 46 is typically represented by a solid body made of a substantially impact resistant and relatively heavy material such as, for examples, steel, cast iron, brass or any suitable metal alloy. The impact anvil 46 is of a larger diameter than the burial sleeve 40 and positionable across the burial sleeve 40 opposed to the driving element 78. The impact anvil 46 typically defines a substantially flat anvil proximal surface 56 and a substantially flat anvil distal surface 58.

The anvil distal surface 58 is provided with a spacing member receiving portion 62 for receiving part of the spacing member 74 thereinto. For example, the spacing member receiving portion 62 takes the form of a centrally disposed and perpendicularly proximally extending recess that is shaped and sized for receiving and engaging therein, in a substantially substantially freely slidable relation, a proximal end portion 64 of the spacing member 74, as illustrated in FIG. 2.

Furthermore, as best illustrated in FIGS. 2 and 16, the impact anvil 46 defines an anvil recess 66 for receiving the urn cap 14 and an anvil shoulder 67 extending peripherally relative to the anvil recess 66 for abutting against the urn body 12, and more specifically the urn proximal surface 22 with the urn cap 14 received in the anvil recess 66. Typically, the anvil recess 66 is coaxially disposed relative to the spacing member receiving portion 62.

In some embodiments of the invention, the anvil distal surface 58 further defines a centrally disposed and concentric sleeve engaging groove 68 that is shaped and sized for receiving and stably engaging therein the burial sleeve 40 adjacent the sleeve proximal aperture 70. The sleeve engaging groove 68 is typically relatively shallower than the spacing member receiving portion 62.

In specific embodiments of the invention, given as example only, the impact anvil 46 has overall dimensions that are ranging roughly between 3 to 5 inches (7.6 to 12.7 cm) of height, and between 3 to 5 inches (7.6 to 12.7 cm) in lateral diameter. Other dimensions are also possible. The spacing member receiving portion 62 may have an overall longitudinal length, including the anvil recess 66 that is roughly between 2 to 3 inches (2.5 to 7.6 cm).

Now referring more particularly to FIGS. 1 and 2, the spacing member 74 is typically generally elongated. In some embodiments of the invention, the spacing member 74 is provided with a transversal opening 76 (seen only in FIG. 1) proximally located for attaching thereto a conventional puller means (not shown) usable for pulling the driving stake 52 out of the ground 13. For example, a relatively simple and commercially available puller means may be represented by a relatively short chain link having one end attachable to the spacing member 74, for example using a screw and nut combination, and the opposite end provided with a transversal handle bar or the like.

The driving element 78 includes a sleeve engaging portion 81 and a ground penetrating element 83. The sleeve engaging portion 81 has a lateral diameter that is slightly smaller than the inner circumferential diameter of the burial sleeve 40 such that the driving stake 52 may be substantially freely slidably inserted therein. The ground penetrating element 83 extends distally from the sleeve engaging portion 81 and is, for example, conical.

Furthermore, the overall longitudinal length of the driving stake 52 is such that, when the driving stake 52 is inserted inside the burial sleeve 40 in an operative configuration, the sleeve engaging portion 81 extends through the sleeve distal aperture 80 and the spacing member 74 protrudes proximally from the burial sleeve 40 such that the spacing member 74 is receivable in the spacing member receiving portion 62 with the burial sleeve 40 received in the sleeve engaging groove 68.

The tubular burial sleeve 40 is represented by a substantially elongated and open ended tubular member having preferably a circular transversal cross-section.

In other embodiments of a funeral urn system 11, according to the present invention, the transversal cross-section of the burial sleeve 40, and consequently the compatibly shaped transversal cross-section of the anvil recess 66 of the impact anvil 46, the urn body 12 of the funeral urn 10, and outer circumference of the driving element 78, may have any other suitable configuration than circular. For examples, an oval transversal cross-section, or a polygonal transversal cross-section such as a hexagonal transversal cross-section or an octagonal transversal cross-section.

In some embodiments of the invention, the burial sleeve 40 is provided with a plurality of burial sleeve screw holes 82 equidistantly disposed around the circumference thereof adjacent the sleeve proximal aperture 70. The burial sleeve screw holes 82 are usable in cooperative relation with a burial marker cap 60 positionable across the sleeve proximal aperture 70 and attachable to the burial sleeve 40 using a corresponding number of screws 84 for closing the sleeve proximal aperture 70, as best illustrated in FIG. 11. The burial marker cap 60 will be described further below.

Thus, with the spacing member receiving portion 62 and the sleeve engaging groove 68 that are stably engaged with the spacing member 74 and the tubular burial sleeve 40 respectively, as illustrated in FIG. 2, the combination represented by the burial tool 50 and the burial sleeve 40 generally forms an elongated member whose pointed distal end can be hammered into the ground 13 using a conventional sledge hammer 90 or the like.

In a specific embodiment of the invention, the burial sleeve 40 may have a longitudinal length of roughly between 6 inches (about 15 cm) and 12 feet (about 3.6 meters). Other length dimensions of the burial sleeve 40 are also possible. For example, the burial sleeve 40 has a longitudinal length of about 5 feet (about 1.5 meters). Furthermore, the burial sleeve 40 may have a diameter of roughly between two inches and 10 inches (roughly between 5 cm and 25.4 cm), although other dimensions are possible. For example, the burial sleeve 40 has a diameter of about three inches (about 7.6 cm).

Once the combination described above has been hammered into the ground 13, with the burial sleeve 40 protruding thereof by, for example, a length of roughly between one inch and two feet (roughly between 2.5 cm and 61 cm), the impact anvil 46 may be removed, followed with the removal of the driving stake 52 by hand or with the help of a conventional puller means if required.

Figure 14:
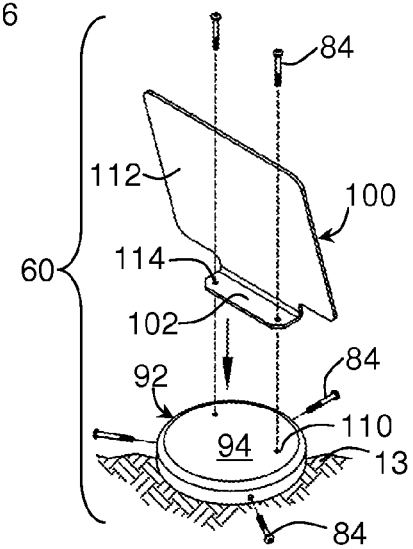
FIG. 14, in a top perspective exploded view, illustrates a burial marker plate in position for assembly on a proximal surface of the cap member, and the assembly of the latter with a proximal end of a burial sleeve (hidden from view) that is partially buried in the ground.

Afterward, the burial marker cap 60 is attached, typically removably, to the burial sleeve 40 using screws 84, for securely closing the sleeve proximal aperture 70, as best illustrated in FIGS. 11 and 14.

Now referring more particularly to FIGS. 11 to 15 inclusively, the burial marker cap 60 generally includes a cap member 92 defining a cap member proximal end portion 94 and a cap member distal end portion 96. The burial marker cap 60 further includes a burial marker plate 100 defining a base portion 102 that is removably attachable to the cap member proximal end portion 94 of the cap member 92 using screws 84.

Figure 12:
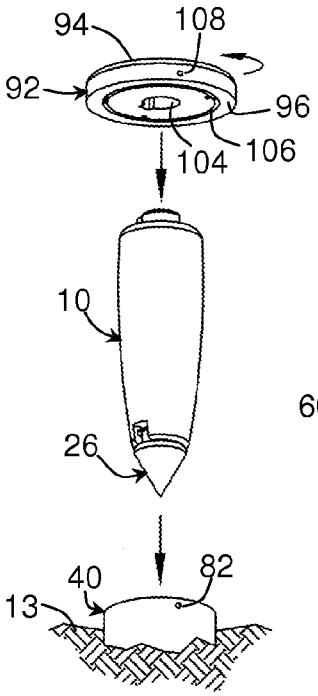
FIG. 12, in a bottom perspective, exploded view, illustrates the assembly of a cap member and a sealed funeral urn attached to a spear head cap, in position above a burial sleeve partially buried in the ground.

As best illustrated in FIG. 12, the burial cap distal end portion 96 defines a substantially flat surface that is provided with a marker distal attachment 104 selectively attachable to the urn proximal attachment 17. The marker distal attachment 104 is shaped similarly to the urn distal attachment 19. Also, typically, a centrally disposed and concentric cap member engaging groove 106 is also formed in the cap member 92.

Figure 13:
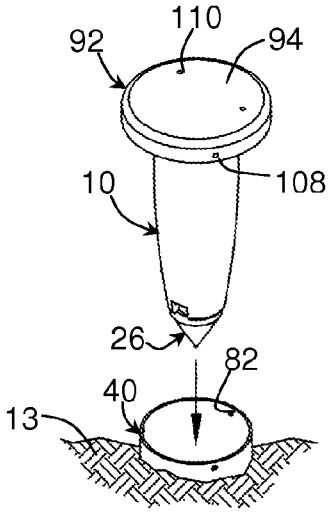
FIG. 13, in a top perspective exploded view, illustrate the assembly of FIG. 12, wherein only the cap member is lockingly engaged with the urn cap of the sealed funeral urn.

The marker distal attachment 104 is for engaging, in a similar fashion as the attachment recess 24 (e.g. in a twist and lock relation) an urn cap 14 that is typically sealingly attached to the proximal end of a funeral urn 10, as best illustrated in FIGS. 12 and 13.

The cap member engaging groove 106 is configured, shaped and sized similar or identical to the sleeve engaging groove 68 of the impact anvil 46 described further above. The cap member engaging groove 106 is for engaging the burial sleeve 40 adjacent the sleeve proximal aperture 70.

The cap member 92 further includes a plurality of cap member screw holes 108 for removably attaching the latter to the burial sleeve 40 using screws 84. The cap member screw holes 108 extend radially inwardly between outer peripheral portions of the cap member 92 and the cap member engaging groove 106. The cap member screw holes 108 are in corresponding number and are equidistantly disposed around the outer peripheral portion of the cap member 92 such that they are substantially in register with the burial sleeve screw holes 82. The cap member proximal end portion 94 is further provided with burial plate screw holes 110, for removably attaching thereto the burial marker plate 100.

As exemplified in the drawings, the burial marker plate 100 may be represented by an angular plate member generally defining a proximal plate portion 112 for inscribing thereon burial markings, epitaphs and the likes, and a base portion 102 that is provided with a plurality of marker plate screw holes 114 for removably attaching the burial marker plate 100 to the cap member proximal end portion 94 of the cap member 92 using screws 84.

It is to be understood that the burial marker plate 100 may have any other suitable configuration such as, for example, a three-dimensional element such as a sphere-shaped member, a cube-shaped member, a cylinder-shaped member, an abstract form, a figurine-shaped form, or the likes.

In some embodiments of the invention, the screws 84 used for removably attaching the burial marker plate 100 to the cap member 92 and the cap member 92 to the burial sleeve 40 have a screw-head key configuration of the temper-proof type that is not compatible with standard screwdriver configurations, for preventing vandalism or unauthorized removal of the burial marker plate 100 and/or the cap member 92. This type of temper-proof screws and compatible screwdrivers are commercially available through specialized markets for original equipment manufacturers (OEM).

The burial sleeve 40, the cap member 92, the burial marker plate 100 and screws 84 are typically made of a substantially rigid and rust proof metal such as, for example, stainless steel, brass, a suitable metal alloy, or the likes.

In an alternate embodiment of a funeral urn system 11 (not shown), according to the present invention, the burial marker cap 60 is removably attached to the burial sleeve 40 in any other suitable manner, for example through a pair of hook members fixedly attached on diametrically opposite sides of the burial sleeve 40. These hook members are used in cooperative relation with an elongated strip of metal bent in a substantially U-shaped configuration for diametrically encompassing the cap member 92 and which is provided with suitable openings at each distal end thereof for engaging the hook members, and a pair of padlocks for selectively locking the burial marker cap 60 on the burial sleeve 40.

In another alternative embodiment of a funeral urn system 11, according to the present invention, the burial marker cap 60, instead of being removably attached to the burial sleeve 40, is fixedly attached thereto using rivets, a conventional soldering process, a conventional thermal bonding process, a suitable glue, or the likes. Thus, the burial marker cap 60 may require thereafter a drill tool, a grinder tool, a blowtorch, or the likes, for removing the latter from the burial sleeve 40.

In yet other alternate embodiments of a funeral urn system 11, according to the present invention, the burial marker plate 100 may be made of stone material such as granite, marble or the likes, that is screwed, glued or otherwise rigidly attached to the cap member proximal end portion 94.

A typical mode of usage of the funeral urn system 11, according to the present invention, generally consists of the following steps.

In a first step, funeral ashes of a deceased person or persons are poured in the urn body 12 of a funeral urn 10, followed with sealing the urn aperture 20 with an urn cap 14, for example using a suitable soldering process.

At this point, the funeral urn 10 may simply be put permanently or temporarily for display, for example, on a horizontal surface at home or at a mausoleum. Optionally, the sealed funeral urn 10 containing the ashes may be buried using the following steps.

In a second step, the burial tool 50 and burial sleeve 40 may be coaxially assembled, along with the impact anvil 46 stably engaged adjacent the sleeve proximal aperture, as illustrated in FIG. 1 to bury the tubular sleeve 40 into the ground 13. For example, this is performed with impacting the anvil proximal surface 56 with sufficient force using, for example, the sledge hammer 90 or the like, for simultaneously driving the driving stake 52 and the burial sleeve 40 into the ground 13 until only a portion of the burial sleeve 40 protrudes from the ground 13.

In a third step, the impact anvil 46 and driving stake 52 are removed using, if required, a puller means attached through the transversal opening 76. The sleeve passageway 71 is therefore substantially empty after the burial sleeve 40 has been buried into the ground 13.

In a fourth step, a first sealed funeral urn 10 has its urn cap 14 lockingly engaged in the marker distal attachment 104 of the burial marker cap 60, and the cap proximal attachment 25 of a spear head cap 26 lockingly engaged into the attachment recess 24 of the funeral urn 10.

In a fifth step, the funeral urn 10 is inserted in the burial sleeve 40 and the burial marker cap 60, sealed funeral urn 10 and spear head cap 26 assembly is engaged and securely attached to the burial sleeve 40 partially buried in the ground 13 using, for example, temper-proof screws 84. The sleeve proximal aperture 70 is thus closed using the burial marker cap 60.

Optionally, additional sealed funeral urns 10 may be buried in a same burial sleeve 40 using the following steps.

In a sixth step, the burial marker cap 60 is unscrewed and removed from the burial sleeve 40, additional sealed funeral urns 10 are serially lockingly engaged to one another, and between the burial marker cap 60 and the spear head cap 26, and the resulting assembly is engaged and securely attached to the burial sleeve 40. The attached funeral urns 10 form an urn stack including a plurality of the funeral urns 10 attached to each other, the urn stack terminating in a point due to the spear head cap 26.

Optionally, in a seventh step, and when the urn stack is longer than the burial sleeve 40, or in other words when the spear head cap 26 abuts at the bottom of the bore created by the driving stake 52, and the last funeral urn 10 at the proximal end of an assembled series protrudes above the burial sleeve 40, as illustrated in FIG. 16, the impact anvil 46 is engaged on top of the proximalmost funeral urn 10, and the sledge hammer 90 or the like is used to impact sufficient force to push the series of sealed urns 10 deeper in the ground 13 until the anvil distal surface 58 abuts against the burial sleeve 40.

While the burial sleeve 40 may be for example only 5 feet long (1.5 meters), an elongated series of mutually engaged sealed urns 10 may thus be relatively easily additionally buried much deeper, and at the same burial site, to reach 25 feet or more (7.6 meters) into, for example, a soft burial ground 13 such as a clay, silt or sand based ground 13, or the like.

In an eighth step, the burial marker cap 60 is lockingly engaged, in a twist and lock relation, with the urn cap 14 of the proximalmost sealed funeral urn 10, and simultaneously engaged on top of the burial sleeve 40, after which the burial marker cap 60 may again be securely attached thereto using temper-proof screws 84.

Optionally, in a tenth step, or simultaneously with any of the steps described above, only the burial marker plate 100 may be temporarily removed for updating the inscriptions appearing on it or replaced altogether with a new one.

Furthermore, serially buried funeral urns 10 at a single location may be relatively easily retrieved from a burial site, for examples, when a forensic examination and analysis on a particular funeral urn is required, or a particular funeral urn needs to be relocated at another site.

In some alternative embodiments of the present invention, a relatively short burial sleeve 40 may have a longitudinal length that is substantially equivalent to the longitudinal length of one sealed funeral urn 10, e.g., comprising an urn body 12 sealed with an urn cap 14. Thus, when a sealed funeral urn 10 is coaxially engaged within such a relatively short burial sleeve 40, one end of the burial sleeve 40 substantially coincide with the urn cap proximal end 28 of the urn cap 14, and the opposite end of the burial sleeve 40 substantially coincides with the urn distal end 18 thereof. Typically, the burial sleeve 40 and sealed funeral urn 10 may both have a longitudinal length of roughly one foot (30 cm). Thus, an alternative method of burying one or more such assembly of a sealed funeral urn 10 and a relatively short burial sleeves 40 is as follows.

In a first step, a spear head cap 26 is lockingly attached to the urn distal attachment 19 of the sealed funeral urn 10, and this assembly is coaxially engaged within a burial sleeve 40 that is substantially the length of the funeral urn 10.

In a second step, a user may abut the spear head cap 26 of the assembly of the previous step on the ground 13, followed with engaging the impact anvil 46 on the urn cap 14 and burial sleeve 40, and driving the assembly in the ground 13 using the sledge hammer 90 or the like.

In a third step, the impact anvil 46 is removed and a burial marker cap 60 is engaged and fixedly attached to the thus protruding burial sleeve 40 and urn cap 14. Thus, a single funeral urn 10 is advantageously and effectively buried requiring only a minimum number of manual operations.

Optionally, in a fourth step, the burial marker cap 60 may be removed, followed with one or more subsequent assembly comprising only a sealed funeral urn 10 that is coaxially engaged in a relatively short burial sleeve 40 (e.g. without a spear head cap 26).

In a fifth step, the assembly of the previous step has its distal end positioned in register and abutting against the proximal end of the burial sleeve 40 and urn cap 14 protruding from the ground 13, followed with driving this additional urn and sleeve assembly, along with the one already buried, deeper in the ground 13.

Using the method described above, there can be typically four to five such urn and sleeve assemblies that are subsequently buried in the ground 13, followed with even more additional sealed urns 10 that are buried therewith, and this time, without additional short burial sleeve 40, depending on the softness of the burial ground 13, using the seventh step of the first method described further above.

Furthermore, it will be appreciated that a person skilled in the art may advantageously use the burial tool 50 for driving, for example, fence stakes in the ground 13. For example, the impact anvil 46 and driving stake 52 may be used to drive in the ground 13 a series of equidistantly disposed burial sleeves 40 along a user defined fence line, followed with inserting the distal end of a fence stake into each hollow sleeve thus buried in the ground 13.

Although the present invention has been described hereinabove by way of preferred embodiments thereof, it can be modified, without departing from the spirit and nature of the subject invention as defined in the appended claims.

What is claimed is:

1. A funeral urn system, said funeral urn system comprising:

a funeral urn defining an urn proximal attachment and a substantially opposed urn distal attachment, said funeral urn including an urn body defining an ashes receiving cavity and an urn aperture leading into said ashes receiving cavity, said funeral urn also including an urn cap selectively securable to said urn body in register with said urn aperture to seal said ashes receiving cavity;

a spear head cap, said spear head cap defining a cap proximal attachment and a substantially opposed cap distal end section tapering in a direction leading away from said cap proximal attachment; and a burial sleeve having a substantially elongated tubular configuration, said burial sleeve being configured and sized for slidably receiving thereinto said funeral urn with said spear head cap attached to said urn distal attachment, wherein said urn proximal and distal attachments are configured and sized to be selectively attachable respectively to urn distal and proximal attachments of an other urn similar to said funeral urn; and said urn distal attachment and said cap proximal attachment are configured and sized to be selectively attachable to each other.

2. A funeral urn system as defined in claim 1, wherein said burial sleeve defines substantially longitudinally opposed sleeve proximal and distal apertures and a sleeve passageway extending therebetween, said sleeve proximal and distal apertures being configured and sized to allow movement of said funeral urn therethrough with said spear head cap attached to said urn distal attachment.

3. A funeral urn system as defined in claim 2, further comprising a burial marker cap positionable across said sleeve proximal aperture and attachable to said burial sleeve.

4. A funeral urn system as defined in claim 1, wherein said burial sleeve is configured and sized for receiving a stack of a plurality of said funeral urn attached to each other through said urn proximal and distal attachments.

5. A funeral urn system as defined in claim 1, wherein said cap distal end section is substantially conical.

6. A funeral urn system as defined in claim 1, further comprising a burial marker cap, said burial marker cap including a marker distal attachment selectively attachable to said urn proximal attachment.

7. A funeral urn system as defined in claim 1, wherein said burial sleeve defines substantially longitudinally opposed sleeve proximal and distal apertures and a sleeve passageway extending therebetween, said sleeve proximal and distal apertures being configured and sized to allow said funeral urn to go therethrough with said spear head cap attached to said urn distal attachment; and said funeral urn system further comprises a burial tool for inserting said burial sleeve into a ground, said burial tool including a driving stake, said driving stake including a driving element defining a driving element point and configured and sized so as to be substantially fittingly received in said burial sleeve, said driving stake also including a spacing member extending from said driving element substantially away from said driving element point, said spacing member being configured and sized so as to extend along about the whole length of said burial sleeve and protrude proximally therefrom when said driving element is positioned in said burial sleeve with said driving element point protruding from said sleeve distal aperture.

8. A funeral urn system as defined in claim 7, wherein said burial tool further includes an impact anvil of a larger diameter than said burial sleeve and positionable across said burial sleeve opposed to said driving element, said impact anvil defining a spacing member receiving portion for receiving part of said spacing member thereinto.

9. A funeral urn system as defined in claim 8, wherein said impact anvil defines an anvil recess for receiving said urn cap and an anvil shoulder extending peripherally relative to said anvil recess for abutting against said urn body with said urn cap is received in said anvil recess.

10. A funeral urn system as defined in claim 1, wherein said urn proximal and distal attachments are configured and sized to be selectively reversibly attachable respectively to said urn distal and proximal attachments of said other urn.

11. A funeral urn system, said funeral urn system comprising:

a funeral urn defining an urn proximal attachment and a substantially opposed urn distal attachment, said funeral urn including an urn body defining an ashes receiving cavity and an urn aperture leading into said ashes receiving cavity, said funeral urn also including an urn cap selectively securable to said urn body in register with said urn aperture to seal said ashes receiving cavity; and a spear head cap, said spear head cap defining a cap proximal attachment and a substantially opposed cap distal end section tapering in a direction leading away from said cap proximal attachment;

wherein said urn proximal and distal attachments are configured and sized to be selectively attachable respectively to urn distal and proximal attachments of an other urn similar to said funeral urn;

said urn distal attachment and said cap proximal attachment are configured and sized to be selectively attachable to each other;

one of said urn proximal and distal attachments includes an attachment protrusion extending substantially longitudinally away from the remainder of said funeral urn and a locking prong extending substantially laterally away from said attachment protrusion spaced apart from said remainder of said funeral urn so as to define an attachment gap between said remainder of said funeral urn and said locking prong; and an other one of said urn proximal and distal attachments includes an attachment recess extending substantially longitudinally into said urn body from an attachment recess outer end to a substantially longitudinally opposed attachment recess inner end, said other one of said urn proximal and distal attachments also defining a locking channel extending substantially laterally from said attachment recess and a locking groove extending substantially circumferentially from said locking channel peripherally relative to said attachment recess and spaced apart from said attachment recess outer end, said attachment recess and said locking channel being respectively configured and sized for longitudinally receiving said attachment protrusion and said locking prong thereinto, said locking groove being also configured and sized for receiving said locking prong thereinto when said attachment protrusion is inserted in said attachment recess.

12. A funeral urn system as defined in claim 11, wherein said attachment protrusion and said attachment recess each have a substantially cylindrical configuration.

13. A funeral urn system as defined in claim 11, wherein said locking channel extends over an arc segment that is between about 45 degrees and about 270 degrees in angular extent.

14. A funeral urn system as defined in claim 11, wherein said one of said urn proximal and distal attachments is said urn proximal attachment and said other one of said urn proximal and distal attachments is said urn distal attachment.

15. A funeral urn system as defined in claim 14, wherein said cap proximal attachment is similar to said urn proximal attachment.

16. A funeral urn system as defined in claim 11, wherein said urn body defines an urn body proximal surface adjacent said urn proximal attachment, said urn aperture extending through said urn body proximal surface, said urn proximal attachment being defined by said urn cap.

17. A funeral urn system, said funeral urn system comprising:

a funeral urn defining an urn proximal attachment and a substantially opposed urn distal attachment, said funeral urn including an urn body defining an ashes receiving cavity and an urn aperture leading into said ashes receiving cavity, said funeral urn also including an urn cap selectively securable to said urn body in register with said urn aperture to seal said ashes receiving cavity; and a spear head cap, said spear head cap defining a cap proximal attachment and a substantially opposed cap distal end section tapering in a direction leading away from said cap proximal attachment; wherein said urn proximal and distal attachments are configured and sized to be selectively attachable respectively to urn distal and proximal attachments of an other urn similar to said funeral urn;

said urn distal attachment and said cap proximal attachment are configured and sized to be selectively attachable to each other; and said cap distal end section tapers to a point opposed to the cap proximal attachment.

18. A method of burying an urn stack including a plurality of funeral urns attached to each other, said urn stack tapering to and terminating in a point, said method using a substantially tubular burial sleeve, said burial sleeve defining a sleeve proximal aperture, a substantially longitudinally opposed sleeve distal aperture and a sleeve passageway extending therebetween, said urn stack being longer than said burial sleeve, said method comprising:

burying in the ground part of said burial sleeve, said sleeve passageway being substantially empty after said burial sleeve has been buried into the ground;

inserting said urn stack in said burial sleeve; and pushing at least said point of said urn stack into said ground such that said urn stack protrudes from said sleeve distal aperture.

19. A method as defined in claim 18, further comprising closing said sleeve proximal aperture using a burial marker cap.

* * * * *